United States Patent [19]

San Miguel

[11] 4,240,351

[45] Dec. 23, 1980

[54] SAFE-ARM DEVICE FOR DIRECTED WARHEAD

[75] Inventor: Anthony San Miguel, Ridgecrest, Calif.

[73] Assignee: The United States of America as represented by the Secretary of the Navy, Washington, D.C.

[21] Appl. No.: 970,414

[22] Filed: Dec. 18, 1978

[51] Int. Cl.[3] ..... F42C 15/40

[52] U.S. Cl. ..... 102/262; 102/254; 102/256

[58] Field of Search ..... 102/262, 254, 256, 258, 102/251, 226, 229, 200

[56] References Cited

U.S. PATENT DOCUMENTS

| | | | |
|---|---|---|---|
| 2,994,272 | 8/1961 | Saunderson | 102/254 |
| 3,066,605 | 12/1962 | Jones | 102/228 |
| 3,157,125 | 11/1964 | Lohmann | 102/251 X |
| 3,311,058 | 3/1967 | Fohrmann et al. | 102/262 X |
| 3,776,138 | 12/1973 | Moses | 102/264 X |
| 3,858,516 | 1/1975 | Rabinow | 102/262 X |
| 3,890,901 | 6/1975 | Anderson et al. | 102/264 X |
| 3,901,156 | 8/1975 | Rognmo et al. | 102/251 X |
| 3,962,974 | 6/1976 | Anderson et al. | 102/229 X |
| 3,991,683 | 11/1976 | Rentzsch | 102/49.6 |
| 4,013,012 | 3/1977 | Giattino | 102/216 |
| 4,023,499 | 5/1977 | Chavee | 102/256 |
| 4,046,076 | 9/1977 | Hampton | 102/262 X |

*Primary Examiner*—David H. Brown

*Attorney, Agent, or Firm*—R. S. Sciascia; W. Thom Skeer; Timothy R. Schulte

[57] ABSTRACT

A safety and arming device for a directed missile warhead using a rotor having a plurality of explosive paths therethrough. A central shaft guides axial and rotary movement of said rotor. Missile launch is sensed and unlatches the rotor. Missile launch acceleration causes the rotor to move axially. Receipt of a second signal causes the rotor to rotate, thereby arming the device by aligning the explosive paths and the detonators. Circuit breakers may also be included on the housing and rotor to produce a continuous electrical path for the firing circuits only when the device is armed.

20 Claims, 3 Drawing Figures

SAFE-ARM DEVICE FOR DIRECTED WARHEAD

BACKGROUND OF THE INVENTION

1. Field of the Invention

This invention pertains to the fields of ammunition and explosive devices. More particularly, this invention pertains to fuses, primers and igniting devices. In still greater particularlty, this invention pertains to a safe-arm device for use with a missile warhead. By way of further characterization and explanation, this invention pertains to a safe-arm device utilizing a solenoid which allows axial and rotational movement of a rotor based on predetermined signals.

2. Description of the Prior Art

The explosive material used in warheads is basically insensitive to shock, vibration, temperature and static electricity. This makes the material safe to handle but also difficult to detonate at the desired time. To cause warhead detonation, a warhead initiation system and explosive train are required. The safe-arm explosive train consists basically of a detonator, explosive leads and an explosive booster or warhead initiation system. The detonator is very sensitive to all elements and is fired by electric energy from the firing circuit. Its explosive output, which is small, then detonates the explosive lead and the explosive lead in turn the explosive booster. The function of the safe-arm is to physically and electrically isolate the detonator from the rest of the explosive train until arming occurs. The warhead initiation system distributes the explosive detonation wave to the proper points of the warhead. For simple isotropic warheads, a sophisticated initiation system is not needed since only a single point of the warhead is detonated.

A directed warhead, such as that shown in U.S. Pat. No. 3,714,897 issued to L. L. Parker on Feb. 6, 1973, requires a safety-arming device capable of processing multi-channel information. The safety-arming device receives a number of signals from the target detecting device and it signals the directed warhead to deform and then detonate in a specified direction. Such a warhead would require a number of explosive leads because the warhead detonation may be in any direction. Prior art devices are limited in the number of explosive leads which they may contain. Because of their complicated nature and size and weight considerations, the devices could not be used where a number of explosive leads are required.

In general, a safety-arm device achieves its safety with barriers in the explosive train that are removed sequentially after missile launch. The final barrier is removed after a safe separation point with respect to the launch medium has been reached. This safe separation point is established through analysis that takes into account such factors as missile debris due to warhead detonation, missile trajectories and the probability of a fragment hit on the launching platform. The safe separation point is typically either a single time or distance with respect to the launching medium. For most rocket motor boosted missiles, distance is used as the criterion for safe separation. When safe separation is achieved, the barriers from the explosive train are removed and the detonator is electrically armed. The explosive train will then be ready to detonate the warhead with the receipt of a signal from either the target detecting device or contact fuse.

Prior safety-arming devices have used an escapement (integrator) for safe arming. One such device is shown in U.S. Pat. No. 3,776,138 issued to S. A. Moses on Dec. 4, 1973. In that device, the detonators are separated from detonating fuses by a rotating, cylindrical shield. The escapement causes the shield to rotate upon acceleration thereby aligning the detonators and fuses. While suited for its intended purpose, the escapement depends only upon acceleration of the missile to arm the warhead. To meet modern fuze safety criteria, a more reliable device with fewer components which utilizes two independent signals to arm the warhead is required.

SUMMARY OF THE INVENTION

A safe-arming device for a directed missile warhead uses a rotor having a plurality of explosive paths therethrough, a central shaft for guiding axial and rotary travel of the rotor, and a housing having a plurality of explosive leads. In the safe position, the rotor is locked by a solenoid operated teeter totter in an out-of-line ("safe") position. That is, the explosive leads on the rear housing plate do not line up with the explosive leads in the rotor which in turn do not line up with the explosive leads in the housing. Upon missile launch, the solenoid is activated, repositioning the teeter totter so that the rotor can advance as a result of missile acceleration. As the rotor advances, a self-loading spring is cocked. Should the acceleration level of the missile be insufficient, the rotor will return to its original position. Upon receipt of a second signal, the solenoid is de-energized, allowing the self-loading spring to rotate the rotor about its axis. The explosive leads are now in line and the device is in the "arm" mode. A pin locks the rotor in the armed position.

DESCRIPTION OF THE PREFERRED EMBODIMENT

Figure 1:
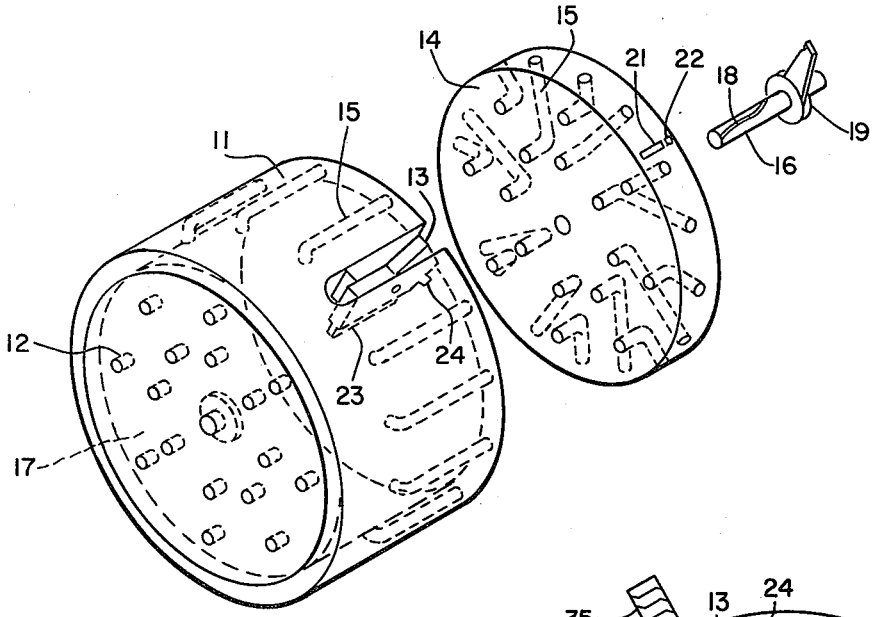
FIG. 1 shows the invention disassembled.

Referring to FIG. 1, a housing 11 contains a plurality of detonators 12. A teeter totter 13 is also mounted on housing 11. Housing 11 and a rotor 14 have a number of explosive leads 15 and 151 respectively therethrough. When assembled, a center shaft 16 extends through rotor 14 and is attached to a rear face 17 of housing 11. A guide (not shown) on the inside of rotor 14 fits into slot 18 on center shaft 15.

Rotor 14 is slidable along center shaft 16 between a pulley assembly 19 and rear face 17 of housing 11. A groove 21 and a hole 22 are cut into the circumferential surface of rotor 14. A shoulder 23 and a pin 24, on teeter totter 13, are matched to groove 21 and hole 22 respectively.

Figure 2:
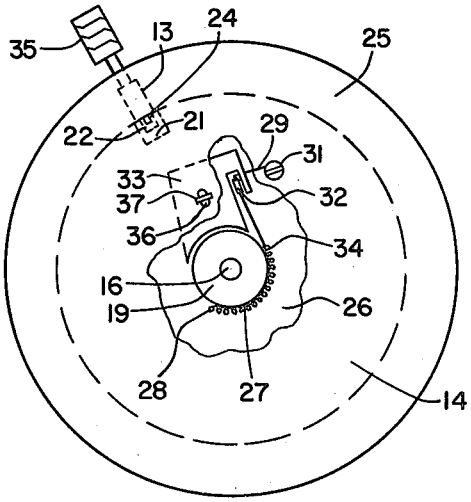
FIG. 2 is a frontal view showing the housing face partially cut away to expose a part of the rotor face.

Referring to FIG. 2, a front housing face 25 is shown in place over rotor 14. A center portion 26 of front face 25 is shown removed to expose certain details of the invention. Pulley assembly 19 is mounted on center shaft 16. A spring 27 is attached to rotor 14 at pin 28. A string 29 is attached to front face 25 at screw 31. String 29 extends through a hole (not shown) in face 25 and is partially wound on a pulley wheel 32. Pulley wheel 32 is attached to mount 33 which is itself attached to rotor 14. String 29 is attached to spring 27 at point 34. An activating means, which may be a solenoid 35, contacts teeter totter 13. Solenoid 35 and teeter totter 13 comprise a controlling means. A spring 36 is connected on one end to mount 33 and on the other end to housing face 25 by pin 37. Solenoid 35, teeter totter 13, springs 27 and 36, groove 21, and hole 22 combine to regulate the movement of rotor 14.

Figure 3:
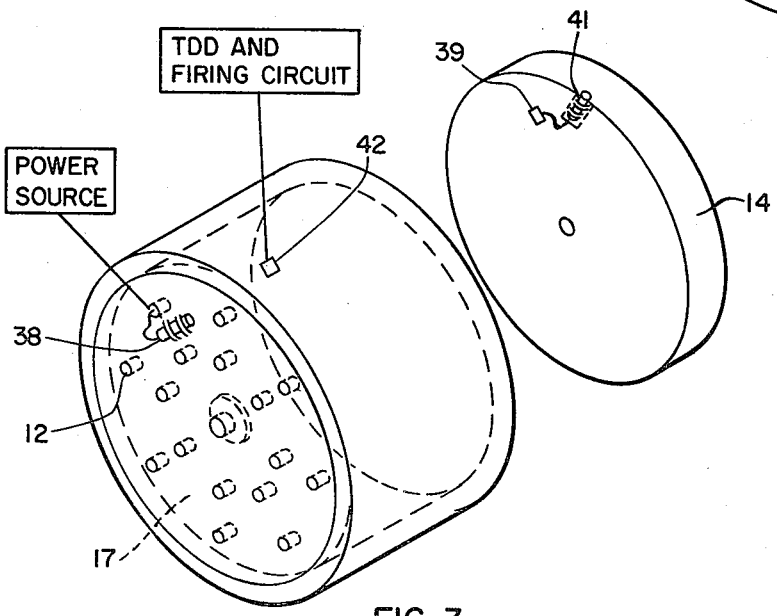
FIG. 3 illustrates an optional safety feature which may be employed with the invention.

Referring to FIG. 3, wherein an optional safety feature is incorporated into the device, detonators 12 are mounted on rear face 17 of housing 11. A spring loaded rod wiper 38, electrically connected to one of detonators 12, is electrically connected to a power source. A copper land 39 is mounted on rotor 14. Copper land is electrically connected to a second spring loaded rod wiper 41. A second copper land 42 is mounted on housing 11 and is connected to a Target Detecting Device (TDD) and to the firing electronics. For purposes of illustration, only one spring loaded rod wiper 38, copper land 39, second spring loaded rod wiper 41, and second copper land 42 are shown. When employed in the device there is one set of these, comprising a circuit breaking means, for each detonator.

MODE OF OPERATION

When assembled, the invention is mounted on a missile warhead in the "safe mode". The "safe mode" means that there is no continuous explosive path through the device, i.e. detonators 12 and explosive leads 15 and 151 are out of line. If a detonator is fired, then the explosive signal will not be transmitted through the housing and rotor. The present invention may be used with directed warheads requiring multiple explosive paths or the device may also be used with simple isotropic warheads requiring only one explosive path.

Referring to FIG. 2, upon missile firing, solenoid 35 is activated which moves teeter totter pin 24 out of hole 22. This same action moves shoulder 23 located on the other end of teeter totter 13 into groove 21. Rotor 14 is then free to move on center shaft 16 subject to the counter force exerted by spring 36.

Referring to FIG. 1, when the missile is fired, the acceleration force on rotor 14 urges it along center shaft 16. A guide (not shown) on the inside of rotor 14 fits into slot 18 on center shaft 16 thereby guiding rotor 14. Slot 18 is angled such that, once rotor 14 has begun to rotate, the guide moves into the angled area thereby preventing rotor 14 from returning forward.

Referring to FIG. 2, spring 36 is chosen such that the expected acceleration force on rotor 14 will be sufficient to overcome the counter force exerted by spring 36. Spring 36 functions as a safety measure to urge rotor 14 into the "safe mode" position if the acceleration force drops below the expected level. As rotor 14 is urged backward along center shaft 16, spring 27 is stretched by string 29. Rotor 14 is prevented from rotating by shoulder 24 in groove 21. Solenoid 35, teeter totter 13, groove 21 and shoulder 23 thus act as a latching means for rotor 14. Similarly, pin 24 acting in conjunction with solenoid 35, teeter totter 13 and hole 22 act as a latching means for preventing axial movement of rotor 14.

A second signal is given to solenoid 35 upon the occurrance of a second predetermined event. The selection of this second predetermined event is based on certain engineering and design considerations. For example, a signal may be given a predetermined time after launch to assure a safe distance between the missile and the launching medium. Alternatively, missile skin or rocket motor temperature could be sensed and, upon reaching a predetermined level, a signal given to solenoid 35.

Upon receiving the second signal, solenoid 35 is activated thereby raising shoulder 23 out of groove 21. Rotor 14 is now free to rotate. Spring 27, which has been cocked by the sliding of rotor 14, now releases its torsional energy thereby rotating rotor 14 and aligning detonators 12 and explosive paths 15 and 151 in rotor 14 and housing 11. The device is now in the "armed" position.

The "armed" position occurs when a continuous explosive path is achieved. That is, an explosive signal given to detonators 12 on the back face of housing 11 travels through explosive leads 151 in rotor 14 to the explosive leads 15 on the circumference of housing 11. The explosive signals are then conducted to the warhead by explosive logic or other conventional means.

The additional safety feature illustrated in FIG. 3 employs a similar operating principle to that used by the explosive signal. That is, wipers 38 and 41 are in electrical contact with lands 39 and 42 respectively only when the device is in the "armed" position. As the missile acceleration urges rotor 14 on the center shaft toward rear face 17, wipers 38 contact rotor 14. When rotor 14 is rotated by spring 27 then land 39 makes electrical contact with wiper 38. Similarly, after the rotation of rotor 14, wiper 41 makes electrical contact with land 42. Therefore, in the "armed" position, there is a continuous electrical path from the TDD and firing electronics to the detonators. The detonators may then be fired by signals from the TDD. In the "safe mode" there is no continuous electrical path and signals from the TDD cannot reach the detectors. Therefore, premature detonation of the detonators caused by spurious signals from the TDD is eliminated.

In the preferred embodiment of the invention, housing 11 and rotor 14 are made of an optically transparent material. This allows for precise and safe assembly. In addition, a functional reliability assessment can be made.

What is claimed is:

1. A safety and arming device which may be used in a directed missile warhead comprising:

a housing having at least two sides with a predetermined number of detonators implanted on one of said sides and a equal number of explosive leads implanted on the other of said sides, said sides connected by a center shaft;

a rotor, rotatably and slidably mounted on said center shaft between said sides, said rotor having implanted therein a number of explosive leads equal to said predetermined number of detonators;

controlling means, connected to said housing for restricting the movement of said rotor; and aligning means, connected to said housing and said rotor, for urging said rotor into a predetermined arming position;

whereby, in said predetermined arming position, said detonators and said explosive leads in said housing and said rotor are aligned to produce a continuous explosive path through said safety and arming device.

2. A safety and arming device according to claim 1 wherein said aligning means includes a spring connected to said housing and to said rotor.

3. A safety and arming device according to claim 1 wherein said housing is made of an optically transparent material.

4. A safety and arming device according to claim 1 wherein said rotor is made of an optically transparent material.

5. A safety and arming device according to claim 1 wherein said controlling means includes:

first latching means, connected to said housing, for preventing axial movement of said rotor;

second latching means, connected to said housing, for preventing rotational movement of said rotor; and activating means, contacting said first latching means and said second latching means, for engaging said first latching means and said second latching means each upon a predetermined signal.

6. A safety and arming device according to claim 5 wherein said activating means includes a solenoid switch.

7. A safety and arming device according to claim 5 wherein said first latching means includes a teeter totter having a pin matched to a hole in said rotor.

8. A safety and arming device according to claim 5 wherein said second latching means includes a teeter totter having a shoulder matched to a groove in said rotor.

9. A safety and arming device according claim 1 wherein said controlling means includes:

a teeter totter; and a solenoid contacting said teeter totter.

10. A safety and arming device according to claim 9 wherein said teeter totter has a pin on one end and a raised shoulder on the opposite end.

11. A safety and arming device according to claim 10 wherein the aforesaid rotor has a groove and a hole in its circumferential surface corresponding to said pin and said raised shoulder on said teeter totter.

12. A safety and arming device comprising:

a housing having at least one explosive path therethrough;

a rotor, mounted on said housing so as to be capable of axial and rotational movement, said rotor having at least one explosive path therethrough;

means, connected to said housing, for regulating the axial and rotational movement of said rotor; and circuit breaking means, connected to said housing and to said rotor, for providing an electrically conductive path through said rotor and said housing;

whereby said explosive paths are aligned by and said electrically conductive path established by the axial and rotational movement of said rotor.

13. A safety and arming device according to claim 12 wherein said circuit breaking means includes:

a plurality of spring loaded rod wipers mounted on said housing and on said rotor, and a plurality of copper lands mounted on said housing and on said rotor so as to be put in electrical contact with said wipers by the axial and rotational movement of said rotor.

14. A safety and arming device according to claim 12 wherein said housing is optically transparent.

15. A safety and arming device according to claim 12 wherein said rotor is optically transparent.

16. A safety and arming device according to claim 12 wherein said regulating means includes:

first latching means, connected to said housing, for preventing axial movement of said rotor;

second latching means, connected to said housing, for preventing rotational movement of said rotor; and torsioning means, connected to said rotor, for rotating said rotor; and activating means, contacting said first latching means and said second latching means, for engaging said first latching means and said second latching means each upon a predetermined signal.

17. A safety and arming device according to claim 16 wherein said first latching means includes a teeter totter having a pin matched to a hole in said rotor.

18. A safety and arming device according to claim 16 wherein said second latching means includes a teeter totter having a shoulder matched to a groove in said rotor.

19. A safety and arming device according to claim 16 wherein said torsioning means includes a spring connected to said housing and to said rotor.

20. A safety and arming device according to claim 16 wherein said activating means includes a solenoid switch.

* * * * *